US005601749A

United States Patent [19]

Hall et al.

[11] Patent Number: 5,601,749

[45] Date of Patent: Feb. 11, 1997

[54] STABILISED GEL SYSTEM AND PRODUCTION THEREOF

[75] Inventors: Sean G. Hall, Hillsborough; John T. McCullins, Belfast, both of United Kingdom

[73] Assignee: S.B. Chemicals Limited of Blaris Industrial Estate, Northern Ireland

[21] Appl. No.: 132,662

[22] Filed: Oct. 6, 1993

Related U.S. Application Data

[63] Continuation of Ser. No. 910,127, filed as PCT/GB91/00052, Jan. 15, 1991, abandoned.

[30] Foreign Application Priority Data

Jan. 15, 1990 [GB] United Kingdom ..... 9000833

[51] Int. Cl.[6] ..... C11D 9/10; C11D 9/18; C11D 9/32; C11D 3/065

[52] U.S. Cl. 510/336; 252/315.6; 510/268,368,403,396

[58] Field of Search ..... 252/109, 116, 252/121, 531, 535, 536, 539, 540, 550, 554, 555, 558, 559, 315.6

[56] References Cited

U.S. PATENT DOCUMENTS

| | | | |
|---|---|---|---|
| 2,920,045 | 1/1960 | Hearn et al. | 252/137 |
| 3,708,428 | 1/1973 | McDonald | 252/109 |
| 3,709,823 | 1/1973 | Sugahara et al. | 252/136 |
| 3,899,447 | 8/1975 | McDonald | 252/539 |
| 4,179,391 | 12/1979 | Kaufmann et al. | 252/99 |
| 4,561,993 | 12/1985 | Choy et al. | 252/174 |
| 4,695,396 | 9/1987 | Rossmann et al. | 252/135 |
| 4,954,327 | 9/1990 | Blount | 423/338 |

FOREIGN PATENT DOCUMENTS 0191372 8/1986 European Pat. Off. .

*Primary Examiner*—José G. Dees
*Assistant Examiner*—Mary C. Cebulak
*Attorney, Agent, or Firm*—Scully, Scott, Murphy & Presser

[57] ABSTRACT

A stabilized gel system for supporting finely divided particulate matter in suspension comprises a hydrosol of silicic acid stabilized by entanglement with micelles of a tenside. Such a stabilized gel system can be used as the basis for a liquid built detergent composition or for an abrasive preparation.

52 Claims, No Drawings

STABILISED GEL SYSTEM AND PRODUCTION THEREOF

This application is a continuation of Ser. No. 07/910,127 filed Sep. 15, 1992, now abandoned which is a 371 of PCT/GB9100052 Jan. 15, 1991.

This invention relates to a stabilised gel system for supporting finely divided particulate matter in suspension, to detergent compositions and abrasive preparations based on such a stabilised gel system, and to the production thereof.

In recent years, mainly for reasons of manufacturing economics, heavy duty built liquid detergents have made in-roads into the spray-dried washing powder market with the result that much work has taken place both on the physics and on the chemistry of product formulation.

Each type of preparation contains the same basic ingredients and in both cases it has been necessary to incorporate materials which can only be regarded as inert diluents of the active compounds in the formulation. In the case of solid preparations the diluent has been alkali metal sulphates whilst in the case of the liquid it has simply been water.

Herein lies the problem in the case of the heavy duty built liquid detergents because the desired performance in a washing machine requires the presence of high percentages of alkaline materials (builders) along with percentages of surface active agents in the region of 9% to 20% (active ingredients). At these concentrations the chemical groupings are incompatible as far as homogeneity of the product is concerned. Such surface active ingredients normally include an anionic surfactant or tenside and may further include one or more non-ionic surfactants. Examples of anionic surfactants include the sodium salts of alkyl benzene sulphonic acids and of alkyl sulphonic acids. As examples of non-ionic surfactants there can be mentioned polyalkylene oxide ethers of alkyl alcohols or alkylphenols, as well as the monoethanolamides of fatty acids, such as coconut fatty acid monoethanolamide.

It follows therefore that conventional heavy duty laundry detergents are composed of two physical phases and consist essentially of saturated solutions of the builders, with excess builder particles present in the liquid mass as a dispersion, and an aqueous solution of surfactant micelles some of which have been salted-out by the electrolytic action of the saturated solution of the builders.

Such a complex mixture of materials with their own interactions and incompatibilities poses a problem to the detergent formulator.

In order to produce a smooth, pourable, homogeneous product for entry into the market place a very large amount of experimental work has been undertaken by laboratories throughout the world and some of the relevant teachings are to be found, for example,-in US-A-3351557, US-A-3574122, CA-A-917631, GB-A-948617 and GB-A-2153839. Reference can also be made to GB-B-2123846, EP-B-086614, EP-B-0170091, EP-B-0151884, GB-B-2153380 and EP-A-0295021. In all cases the aim has been to produce some sort of structured liquid system which can hold the excess inorganic builder particles in a thixotropic suspension. This has been accomplished in various ways such as by an emulsion technique, by micronising, or by ball-milling. Typically such a conventional liquid built detergent composition has a storage life of at least several months. However, upon centrifuging at 800 g for 17 hours at 25° C. such compositions normally separate into two or more phases. Although such compositions have good storage properties, it would be desirable to provide liquid built detergent compositions with even better storage characterisitics.

It is apparent that in such heavy duty built systems the builders and the surfactants physically interact so that each is above the limits of its water solubility. In the case of the builders the system is saturated with respect to the soluble salts and the excess must be homogeneously held in stable suspension, while in the case of the surfactants the tenside micelles are either forced to contract from a linear conformation to gathered-up bundles, or at the limit, to be salted out of solution as high strength surfactant hydrates. Overall, therefore, the separated phases are in equilibrium with their own moieties in the continuous aqueous system. Normally, upon salting out, anionic surfactants give rise to formation of solid hydrates. The presence of such solid anionic surfactant hydrates can give rise to formation of a composition in which the presence of spherulites of surfactant hydrate can be detected or in which the composition contains the surfactant as a lamellar liquid crystal or solid hydrate interspersed with an aqueous phase containing dissolved electrolyte. On the other hand non-ionic surfactants do not, generally speaking, form hydrates, although they may be salted out of solution due to the presence of high concentrations of dissolved electrolyte.

There is accordingly a need in the art to provide an improved system for supporting finely divided particulate matter, such as builders or abrasives, in suspension. There is also a need for an improved liquid built detergent formulation which is stable under normal storage conditions for extended periods. There is a further need in the art to provide a liquid built detergent composition, and a process for making same, in which the problems of the prior art are substantially obviated.

The present invention accordingly seeks to provide an improved liquid built detergent composition and a process for making same in which the problems encountered in the prior art are substantially obviated. It also seeks to provide an improved system for supporting finely divided particulate matter in suspension.

According to the present invention there is provided a stabilised gel system for supporting finely divided particulate matter in suspension comprising a hydrosol of silicic acid stabilised by entanglement with micelles of a tenside. Preferably the tenside is one containing one or more sulphonic acid or sulphonate groups. Such a stabilised gel system can conveniently be produced by at least partially neutralising a sodium silicate solution with a tenside containing one or more sulphonic acid groups. Such a stabilised gel system is normally acidic or near neutral in character. Typically the pH of a liquid support system in accordance with the invention lies in the range of from about 1.0 to about 9.0. Normally it will have a pH of not more than about 8.0, e.g. in the range of from about 4.0 to about 7.5.

In another aspect of the invention there is provided a liquid built detergent composition comprising a hydrosol of silicic acid stabilised by entanglement with micelles of a tenside containing one or more sulphonic acid or sulphonate groups.

Also provided in accordance with the present invention is an abrasive preparation comprising a hydrosol of silicic acid stabilised by entanglement with micelles of a tenside in which are dispersed finely divided particles of an abrasive material. Preferably the tenside in such an abrasive preparation is one containing one or more sulphonic acid or sulphonate groups. Such an abrasive composition can be formulated as an oven cleaner, for example, or as a cleaner for hard surfaces.

There is further proposed, according to a still further aspect of the invention, a process for the production of a stabilised gel system for supporting finely divided particulate matter in suspension which comprises neutralising a solution of an alkali metal silicate to a pH in the range of from about 1.0 to about 7.0 in the presence of a tenside thereby to produce a hydrosol of silicic acid stabilised by entanglement with tenside micelles.

Neutralisation may be effected by addition of an acid to a solution of an alkali metal silicate that contains also at least-one surfactant. The acid may be selected from hydrochloric acid, sulphuric acid, sulphamic acid, phosphoric acid, formic acid, acetic acid, citric acid, and mixtures of two or more thereof. Alternatively neutralisation may be effected by titration of the solution of alkali metal silicate with a tenside containing one or more sulphonic acid groups.

In another mode of production of a stabilised gel system according to the invention a solution having a pH of not more than 7.0 is produced by dissolving in an aqueous medium a tenside containing one or more sulphonic acid groups and an alkali metal tripolyphosphate and a solution of an alkali metal silicate is added thereto.

The invention further provides a process for the production of a liquid built detergent composition which comprises neutralising a solution of an alkali metal silicate, such as sodium silicate, to a pH in the range of from about 1.0 to about 7.0 by titration with a tenside containing one or more sulphonic acid groups.

The invention further relates to a process for the production of a liquid built detergent which comprises neutralising a solution of an alkali metal silicate to a pH in the range of from about 1.0 to about 7.0 in the presence of a tenside thereby to produce a hydrosol of silicic acid stabilised by entanglement with tenside micelles and, either before or after the neutralisation step, incorporating a builder in the composition. In such a process neutralisation can be effected by addition of an acid to a solution of an alkali metal silicate that also contains at least one surfactant and in which the builder is thereafter added. Alternatively neutralisation can be effected by titration of the solution of alkali metal silicate with a tenside containing one or more sulphonic acid groups.

In another form of such a process a solution having a pH of not more than 7.0 is produced by dissolving in an aqueous medium a tenside containing one or more sulphonic acid groups and an alkali metal tripolyphosphate and a solution of an alkali metal silicate is added thereto.

In the detergency technology of the prior art there are no examples disclosed, so far as is known, in which a pourable gel system, based on silicates, has been produced by a chemical reaction. The reason for this can be found in the fact that chemical theory does not indicate that such gel or colloidal systems are possible by this route. However, according to the present invention it is possible to produce a very stable, pourable gel or viscous colloidal system by the chemical interaction of an anionic surfactant with an alkali metal silicate constituent of the builder system.

Amongst the known effects of acids on solutions of alkali metal silicates it is known that:

(1) When a strong acid is added to a sodium silicate solution a precipitate of silicic acid separates as a gelatinous mass (hydrogel) but some still remains in colloidal solution (hydrosol). It is possible to dialyse the hydrosol but a 5% solution of colloidal silica is about the maximum strength that can be obtained.

(2) The passage of silicic acid from the sol to the gel condition is retarded by the presence of a little acid, or hydroxide, but it is very much accelerated by the addition of sodium carbonate or of a phosphate; in fact the addition of one of the latter compounds invariably leads to rapid coagulation.

(3) When the pH value of a solution of sodium silicate is reduced from its normal value, which is typically in the range of from about 11.0 to about 13.0, to a value in the range of from about 8.0 to about 9.0 by the use of sodium hydrogen carbonate, the hydrosol produced is stable for a matter of hours, before coagulation occurs, and as such is used in water and sewage treatment as "activated silica".

In the new silicate chemistry work, which forms the basis of this invention, the following unexpected results can be disclosed:

(4) When a strong solution of sodium silicate, for example one-produced by a few dilutions of the 47% grade known as CRYSTAL 120 H, is titrated with an anionic detergent, in the free sulphonic acid form, to a pH value in the range of from about 1.0 to about 8.0, a soft gel is produced which can be diluted with water to give a stable syrup without precipitates.

(5) When a 5% solution of sodium metasilicate or sodium silicate soluble glass is titrated to pH 7.0 with a 10% w/w solution of dodecylbenzene sulphonic acid, a transparent syrup is produced which is stable for an extended period and is not precipitated, or coagulated, by the addition of a solution either of an alkali metal carbonate, or of a phosphate, or of a polyphosphate.

(6) When a quaternary ammonium chloride (QAC) such as a benzalkonium chloride is added to a sodium silicate solution and the pH value is reduced to 7.0 to 8.0, a transparent syrup is produced which is stable and does not precipitate silicic acid even though a mineral acid, such as hydrochloric acid, is used to neutralise the silicate solution. Such a syrup can be used as a stabilised gel system for supporting, for example, abrasive particles, to form an abrasive preparation such as an oven cleaner.

(7) Similar results to those summarised at (6) above were obtained when a sodium silicate solution containing a non-ionic surfactant, e.g. Synperonic A7™, was titrated to pH 7.0 to 8.0 using hydrochloric acid. Again, the resulting syrup can be used as a stabilised gel system for suspending finely divided particulate matter such as abrasive parties or builder particles.

From this work it can be seen that it is possible to interfere with normal hydrosol-hydrogel reactions of acidified sodium silicate solutions, as described above at (1), and thus force the separating silicic acid into a physical entanglement with the tenside micelles so that mutual stability is attained with respect to the colloidal silica and the surfactant moieties.

In particular it can be shown that it is not possible to precipitate hydrogels of silicic acid when sodium silicate is decomposed, even at pH 1.0, by detergent sulphonic acids. This result would not be chemically predictable. The resulting pourable colloidal viscous syrups are excellent media for uniting the separate phases of heavy duty laundry detergent liquids. During manufacture of these liquids little attention need be paid to the order in which the ingredients of a liquid detergent formulation are added, according to the teachings of this invention, so long as the sodium silicate in aqueous solution is first neutralised, or partly neutralised, by the tenside sulphonic acid, or acids, of the formulation or by neutralisation or partial neutralisation with non-tenside acids in the presence of tensides or surfactants.

Even though an anionic surfactant in the free sulphonic acid form, such as dodecyl benzene sulphonic acid, is a strong acid, a gelatinous precipitate of silicic acid, i.e. a hydrogel, is not produced when it is used to neutralise a sodium silicate solution. Instead a viscous solution, i.e. a hydrosol, is produced. This result is consistent with the theory that a stabilised gel system according to the invention comprises a hydrosol of silicic acid stabilised by entanglement with micelles of a tenside. Further evidence for such a structure is provided by electron microscopy studies on a liquid built detergent composition prepared from a stabilised gel system according to the invention. Such studies indicated that the liquid built detergent contained a largely featureless granular structure with crystals of builder distributed apparently at random. In particular such electron microscopy studies showed no sign of any spherulites and no sign of any lamellar structure. Hence there was no evidence that any of the surfactant was present as a lamellar liquid crystal or solid hydrate. Thus there did not appear to be any salting out of the anionic surfactant (i.e. sodium salt of dodecyl benzene sulphonic acid) despite the presence of large amounts of builder (i.e. sodium tripolyphosphate) in excess of its solubility limit. This is in contrast to the results reported in EP-B-0086614 and in GB-B-2123846, in which a vesicular, spherulitic or lamellar structure was apparent in a liquid built detergent composition containing comparable amounts of builder and of anionic surfactant added as a sodium salt.

Examples of anionic surfactants (named here, for convenience, as elsewhere in the specification, in the free acid form) which can be utilised in the present invention include alkyl benzene sulphonic acids, in which the alkyl group contains from about 6 to about 20 carbon atoms, for example from 10 to 14 carbon atoms, alkyl sulphonic acids containing from about 10 to about 26 carbon atoms, for example from 10 to 14 carbon atoms, and alpha-olefin sulphonic acids obtained by sulphonation of an alpha-olefin containing, for example from about 10 to about 22 carbon atoms, such as a $C_{16}$ to $C_{18}$ olefin or a mixture containing same. Besides a surfactant containing a sulphonic acid group there may also be present a sulphated fatty alcohol or a sodium salt thereof; typical sulphated fatty alcohols include those containing from about 10 to about 26 carbon atoms, for example a sulphated fatty alcohol mixture containing $C_{10}$, $C_{12}$, $C_{14}$, $C_{16}$ and $C_{18}$ fatty alcohols. Typical of such a fatty alcohol mixture is one containing alcohols in the following proportions: $C_{10}$ 3.0%, $C_{12}$ 57.0%, $C_{14}$ 20.0%, $C_{16}$ 9.0% and $C_{18}$ 11.0%.

Typically a liquid built detergent composition according to the invention contains from about 2% w/w up to about 30% w/w of anionic surfactant (calculated as sulphonic acid) based upon the total weight of the composition.

The composition of the invention may further include one or more non-ionic surfactants. Typical non-ionic surfactants include fatty acid monoethanolamides such as coconut fatty acid monoethanolamide, a typical formulation for which is a mixture of monoethanolamides of fatty acids as follows: $C_6$ 0.5%, $C_8$ 6.5%, $C_{10}$ 6.0%, $C_{12}$ 6.0%, and $C_{18}$ (linoleic) 1.5%. Other suitable non-ionic surfactants include polyoxyalkylene ethers of alkanols, typically polyoxyethylene ethers of alkanols containing from about 6 to about 20 ethylene oxide groups and based upon alkanols containing from about 6 to about 26 carbon atoms. Such alkanols and alkanol mixtures can be produced by hydrogenation of methyl esters produced by transesterification of naturally occurring vegetable oils such as coconut oil, sunflower oil, palm oil, rape seed oil, and the like, or of animal fats, such as tallow or lard. A typical polyoxyethylene ether of an alkanol is based upon lauryl alcohol condensed with approximately 8 moles of ethylene oxide.

Typically the concentration of non-ionic surfactant, if present, in the liquid built detergent composition ranges from about 0.5% w/w up to about 30% w/w based upon the total weight of the composition.

Other ingredients which may be included in the liquid built detergent composition of the invention include preservatives, optical brighteners, bleaches, fragrances, zeolites, foam depressants, foam boosters and/or stabilisers, soaps, dyes, buffers, corrosion inhibition agents, bleach activators, enzymes, humectants, enzyme stabilisers, and the like. Such minor ingredients do not usually comprise more than about 5% w/w each of the total composition, mostly less than about 1% w/w each of the total composition, and more usually do not together amount to more than about 5% w/w in total based upon the weight of the composition.

As an example of a builder there can be mentioned in particular sodium tripolyphosphate. Potassium tripolyphosphate can alternatively be used. The pyrophosphates, metaphosphates, orthophosphates, tetraphosphate, phosphonates such as acetonodiphosphonates, aminotrismethylenephosphonates, ethylenediamine tetramethylene phosphonates, and carbonates of sodium and potassium have also been suggested as builders, as have also zeolites and organic sequestering agents, such as nitrilotriacetic acid, ethylene diamine tetraacetic acid, and polymeric carboxylic acids and their salts, such as polyacrylic acid and polymethacrylic acid.

A typical liquid built detergent composition according to the invention comprises from about 5% w/w up to about 40% w/w based upon the total weight of the composition of a builder or builders.

For further details of ingredients which can be included in a liquid built detergent composition reference may be made to GB-B-2123846.

Upon preparing a stabilised gel system according to the invention the pH is typically in the range of from about 1.0 to about 8.0, preferably about pH 4.0. Upon addition of the builder in the production of a liquid built detergent according to the invention a pH increase is often observed. In some cases the pH may rise above about 7.0, when starting from a stabilised gel system at a pH of about 4.0; hence the final pH may be as high as about 9.0 or even a little higher.

The liquid built detergents of GB-B-2123846 are characterised by the fact that, upon centrifuging at 800 times normal Earth gravity for 17 hours at 25° C., these compositions separate into a first, predominantly aqueous, liquid phase, containing dissolved electrolyte, and at least one other phase. It is an advantage of our invention that, if a stabilised gel system is prepared of sufficient strength, then this may be used to prepare a liquid built detergent composition which does not separate into two or more phases upon centrifuging at 800 times normal Earth gravity for 17 hours at 25° C. For this purpose it is desirable to formulate the liquid built detergent composition, if starting from sodium silicate as the precursor for the silicic acid hydrosol, from a mixture of ingredients that includes at least about 3.0% by weight of sodium silicate (or an equivalent amount of another soluble silicate) up to about 8% by weight based upon the total weight of the liquid built detergent composition. By selecting an appropriate quantity of sodium silicate (or equivalent) as an ingredient for manufacture of the liquid built detergent composition of the invention it is possible to support amounts as high as about 25% or more of builder in a manner such that no separation of phases occurs upon centrifugation at 800 times normal Earth gravity at 25° C. In the course of our experiments we have produced liquid built detergent compositions that exhibit little or no separation of phases, even when centrifuged at 2000 times normal Earth gravity at 25° C. for 17 hours. These experimental results indicate that our liquid built detergent compositions should exhibit superior storage stability to those of GB-B-2123846.

The invention is further illustrated in the following Examples in which all percentages are by weight.

EXAMPLE 1

This describes preparation of a type of liquid which has been shown to be very stable in terms of time (shelf-life) and thermal cycling (environmental stability).

| | |
|---|---|
| Linear Alkylbenzene Sulphonic Acid | 11% |
| Coconut Fatty Acid Monoethanolamide | 2% |
| Sodium Tripolyphosphate | 20% |
| Sodium Silicate (47%) Syrup | 6% |
| Sodium Carbonate Anhydrous | 3% |
| Hydrotrope H-66 (trade mark) | 2% |
| Optical Brightener | 0.15% |
| Formaldehyde (40%) Solution | 0.75% |
| Silicone Antifoam Emulsion | 0.01% |
| Fragrance | 0.50% |
| Water to produce on a W/W basis | 100% |

The alkylbenzene sulphonic acid, or mixture of alkylbenzene sulphonic acids, is dissolved in about twice its own weight of water and added to the sodium silicate which was previously diluted with three times its weight of water. To the resulting transparent syrup, with slow stirring, are added all the other ingredients to produce a shining white, or glossy, pourable syrup which is further diluted with water to give the full batch of product at 100% by weight basis. A suitable alkyl benzene sulphonic acid is dodecyl benzene sulphonic acid.

EXAMPLE 2

In this Example a stable colloidal syrup, or pourable gel, is obtained by acidification of alkali metal silicate solutions which contain surfactants before the titration is attempted. This method of production of heavy duty laundry detergents utilises the following ingredients:

| | |
|---|---|
| Sodium Alkyl Benzene Sulphonate | 11% |
| Coconut Fatty Acid Monoethanolamide | 2% |
| Sodium Tripolyphosphate | 20% |
| Sodium Silicate (47%) Syrup | 5.5% |
| Sodium Carbonate Anhydrous | 3% |
| Optical Brightener | 0.15% |
| Formaldehyde (40%) Solution | 0.75% |
| Silicone Antifoam Emulsion | 0.01% |
| Hydrotrope H-66 (trade mark) | 2.00% |
| Fragrance | 0.50% |
| Hydrochloric Acid (25%) | as required |
| Water to produce W/W | 100% |

The sodium alkylbenzene sulphonate (e.g. sodium dodecyl benzene sulphonate) is twice diluted with water and placed in a pan and to it is added the sodium silicate syrup which can, if desired, be diluted with three volumes of water before addition to the pan. The mixture is slowly stirred and the pH value of the solution reduced to 8.0 by the use of the correct aliquot of the 25% hydrochloric acid. Once the reaction is over, which is about two minutes after the last addition of hydrochloric acid, the remainder of the water is added followed by the addition of the other ingredients in any order. Final adjustment to the required weight is by the last addition of water. A product similar to that of Example 1 is obtained.

EXAMPLE 3

A liquid built detergent composition is prepared from the following ingredients:

| | |
|---|---|
| Dodecylbenzensulphonic acid | 10.0% |
| Sodium silicate (47%) syrup about | 6.5% |
| Coconut Fatty Acid Monoethanolamide | 1.4% |
| Sodium carboxymethylcellulose | 0.1% |
| Sodium tripolyphosphate | 24.2% |
| Preservative | 0.2% |
| Alcohol ethoxylate | 1.3% |
| Hydrotrope H66 | 0.5% |
| Antifoam | 0.2% |
| Fragrance | 0.2% |
| Enzyme | |
| Esperase | 0.4% |
| Termamyl | 0.4% |
| Optical brightener | 0.1% |
| Water To | 100% |

The alcohol ethoxylate used in this Example was a polyoxyethylene ether obtained by condensing 7 moles of ethylene oxide with a $C_{13/15}$ alcohol.

First of all the sodium carboxymethyl cellulose is dissolved in water. The coconut fatty acid monoethanolamide is also dissolved in hot water. Then the dodecylbenzene sulphonic acid is diluted with about twice its own weight of water. To this is added with vigorous stirring the sodium silicate syrup which has previously been diluted with about three times its own weight of water. Sufficient of this diluted sodium silicate syrup is added to give a pH of about 4.0. Then the sodium carboxymethyl cellulose solution is added, followed by the coconut fatty acid monoethanolamide solution, while continuing to stir. Next the sodium tripolyphosphate is added with stirring, followed by the other minor ingredients. Finally the composition is diluted to the desired strength with water.

The resulting composition is stable and does not separate out into separate layers even after several months storage. Moreover, upon centrifugation at 800 g for 17 hours, no separation of phases can be detected. There is no sign of any formation of vesicles or spherulites, nor is there any evidence of any of the surfactant being present as a lamellar liquid crystal or solid hydrate. Hence, upon electron microscopic evaluation of the detergent composition of this Example, the observations recorded were consistent with a largely featureless granular structure with crystals of sodium tripolyphosphate distributed at random.

EXAMPLE 4

A liquid built detergent composition is produced from the same ingredients as are used in Example 3 except that the addition of the sodium silicate syrup is delayed until after-addition of the sodium tripolyphosphate. The sodium carboxymethyl cellulose and the coconut fatty acid monoethanolamide are each dissolved separately in hot water. Then the dodecylbenzene sulphonic acid is diluted with about twice its own weight of water. The sodium carboxymethyl cellulose solution and the coconut fatty acid ethanolamide solution are added in turn to the dodecylbenzene sulphonic acid solution with vigorous stirring to yield a solution having a pH of about 7.0 or lower, followed by the other minor ingredients. Lastly the sodium silicate syrup, which has previously been diluted with twice its own weight of water, is added whilst continuing to stir vigorously. Finally the composition is diluted with water to the desired strength.

The resulting liquid built detergent composition is similar to that of Example 3 except that it exhibits initially a somewhat lower viscosity. It does not separate into layers upon centrifugation at 800 g for 17 hours. It does not show any indication that any spherulites or vesicles are present, nor is there any evidence of any of the surfactant being present in the form of a lamellar liquid crystal or solid hydrate. Moreover, the results of electron microscopy evaluation indicate that the liquid built detergent composition of this Example has a largely featureless granular structure with randomly distributed crystals of sodium tripolyphosphate Although it is not required that this innovation be explained in terms of physical chemistry it is interesting to note that very concentrated hydrosols of silicic acid must be produced, without any tendency to coagulate or precipitate to rigid gels, because as the alkylbenzene sulphonic acid is titrated to the neutral point with silicate solution the electrical conductivity of the solution decreases due to the disappearance of hydroxonium ions as donated from the sulphonic acid. This type of tenside/silicic acid hydrosol reaction is not restricted in its application to the production of heavy duty laundry detergents.

In another example a soft anionic gel or syrup can be loaded with fine abrasive and used as an oven, or hard surface, cleaner.

Hence the invention is not restricted, in its application, to pourable gel systems in heavy duty laundry detergents.

We claim:

1. A liquid built detergent composition which contains suspended builder particles substantially uniformly distributed therein, said composition consisting essentially of a stable hydrosol of silicic acid formed by neutralising a solution of from about 3% w/w up to about 8% w/w (based upon the weight of the composition) of an alkali metal silicate to a pH in the range of from about 1.0 to about 8.0 in the presence of from about 2% w/w up to about 30% w/w (based upon the weight of the composition) of a tenside, said hydrosol containing (i) an amount in excess of its solubility limit and in the range of from about 5% w/w up to about 40% w/w of a particulate builder substantially uniformly distributed therein, (ii) from 0.5% w/w up to about 30% w/w of at least one non-ionic surfactant, (iii) from 0 to about 5% w/w of a bleach, (iv) from 0 to about 5% of a bleach activator, and (v) from 0 to about 5% w/w in total of one or more minor ingredients, any minor ingredient being present in an amount of up to about 2% w/w and being selected from preservatives, optical brighteners, fragrances, foam depressants, foam boosters, foam stabilisers, soaps, dyes, pigments, buffers, corrosion inhibitors, sequestration agents, anti-ingestion agents, humectants, enzymes, enzyme stabilisers, fabric softeners and fabric conditioners.

2. A liquid built detergent composition according to claim 1, wherein the pH of the stable hydrosol of silicic acid lies in the range of from about 4.0 to about 7.5.

3. A liquid built detergent composition according to claim 1, in which the tenside is an anionic surfactant derived from a tenside acid selected from alkyl benzene sulphonic acids, in which the alkyl group contains from about 6 to about 20 carbon atoms, alkyl sulphonic acids containing from about 10 to about 26 carbon atoms, alpha-olefin sulphonic acids obtained by sulphonation of an alpha-olefin containing from about 10 to about 20 carbon atoms, and mixtures thereof.

4. A liquid built detergent composition according to claim 1, which further comprises a sulphated fatty alcohol or a sodium salt thereof.

5. A liquid built detergent composition according to claim 1, in which the builder comprises sodium tripolyphosphate.

6. A liquid built detergent composition according to claim 1, in which the at least one non-ionic surfactant comprises coconut fatty acid monoethanolamide.

7. A liquid built detergent composition according to claim 1, in which the at least one non-ionic surfactant comprises a polyoxyalkylene ether of an alkanol containing from about 6 to about 20 ethylene oxide groups and based upon an alkanol containing from about 6 to about 26 carbon atoms.

8. A liquid built detergent composition according to claim 1, in which the pH is in the range of from about 4.0 to about 9.0.

9. A process for the production of a liquid built detergent composition containing substantially uniformly distributed therein suspended particles of a particulate builder, which process comprises neutralising a solution of an alkali metal silicate to a pH in the range of from about 1.0 to about 8.0 in the presence of a tenside thereby to produce a stable hydrosol of silicic acid and, either before or after the neutralisation step, incorporating an amount in excess of its solubility limit of a particulate builder in the composition in an amount of from about 5% w/w to about 40% w/w of the composition.

10. A process according to claim 9, in which neutralisation is effected by addition of an acid to a solution of an alkali metal silicate that also contains at least one surfactant and in which the builder is thereafter added.

11. A process according to claim 10, in which the acid is selected from hydrochloric acid, sulphuric acid, sulphamic acid, phosphoric acid, formic acid, acetic acid, citric acid, and mixtures of two or more thereof.

12. A process according to claim 9, in which neutralisation is effected by titration of the solution of alkali metal silicate with a tenside acid containing one sulphonic acid group.

13. A process according to claim 9, in which a solution having a pH of not more than 7.0 is produced by dissolving in an aqueous medium (1) a tenside acid containing one sulphonic acid group and (2) an alkali metal tripolyphosphate and a solution of an alkali metal silicate is added thereto.

14. A process according to claim 9 or 13, in which the alkali metal silicate is sodium silicate.

15. A process according to claim 9 or 13, in which the tenside is an anionic surfactant derived from a tenside acid selected from alkyl benzene sulphonic acids, alkyl sulphonic acids and alpha-olefin sulphonic acids.

16. A process according to claim 9, in which there is further added at least one non-ionic surfactant.

17. A process according to claim 16, in which the non-ionic surfactant comprises coconut fatty acid ethanolamide.

18. A process according to claim 9, in which there is incorporated in the composition, either before or after the neutralisation step, a sulphated fatty alcohol or a sodium salt thereof.

19. A process according to claim 15, in which there is used from about 2% w/w up to about 30% w/w of anionic surfactant (calculated as sulphonic acid) based upon the total weight of the composition.

20. A process according to claim 9, in which the amount of builder or builders comprises from about 5% w/w up to about 40% w/w based upon the weight of the composition.

21. A process according to claim 9, in which the builder comprises sodium tripolyphosphate.

22. A process according to claim 9, in which there is incorporated in the composition, either before or after the neutralisation step about 0.5% w/w up to about 30% w/w of at least one non-ionic surfactant.

23. A process according to claim 22, in which the at least one non-ionic surfactant comprises coconut fatty acid monoethanolamide.

24. A process according to claim 22, in which the at least one non-ionic surfactant comprises a polyoxyalkylene ether or an alkanol containing from about 6 to about 20 ethylene oxide groups and based upon an alkanol containing from about 6 to about 26 carbon atoms.

25. A process according to claim 9, in which there is used from about 3% w/w up to about 8% w/w of sodium silicate based upon the weight of the composition.

26. A process according to claim 9 or 13, which further comprises incorporating in the composition, either before or after the neutralisation step, at least one material selected from preservatives, optical brighteners, bleaches, fragrances, foam depressants, foam boosters, soaps, dyes, buffers, corrosion inhibitors, sequestration agents, bleach activators, enzymes, humectants, and enzyme stabilisers.

27. A process according to claim 9 or 13, in which the pH of the resulting composition is in the range of from about 4.0 to about 9.0.

28. A liquid built detergent composition which has a pH in the range of from about 4.0 to about 9.0 and contains suspended particles of sodium tripolyphosphate builder substantially uniformly suspended therein, said composition comprising a stable hydrosol of silicic acid formed by neutralising a solution of from about 3% w/w up to about 8% w/w (based upon the weight of the composition) of an alkali metal silicate to a pH in the range of from about 1.0 to about 8.0 in the presence of from about 2% w/w up to about 30% w/w (based upon the weight of the composition) of a tenside, said hydrosol containing (a) an amount in excess of its solubility limit and up to about 40% w/w of a particulate sodium tripolyphosphate builder substantially uniformly distributed therein, (b) from 0.5% w/w up to about 30% w/w of at least one non-ionic surfactant, (c) from 0 to about 5% w/w of a bleach, (d) from 0 to about 5% of a bleach activator, and (e) from 0 to about 5% w/w in total of one or more minor ingredients, any minor ingredient being present in an amount of up to about 2% w/w and being selected from preservatives, optical brighteners, fragrances, foam depressants, foam boosters, foam stabilisers, soaps, dyes, pigments, buffers, corrosion inhibitors, sequestration agents, anti-ingestion agents, humectants, enzymes, enzyme stabilisers, fabric softeners and fabric conditioners.

29. A liquid built detergent composition having a pH in the range of from about 4.0 to about 9.0 and containing suspended particles of sodium tripolyphosphate builder substantially uniformly suspended therein, said composition consisting essentially of a stable hydrosol of silicic acid formed by neutralising a solution of from about 3% w/w up to about 8% w/w (based upon the weight of the composition) of an alkali metal silicate to a pH in the range of from about 1.0 to about 8.0 in the presence of from about 2% w/w up to about 30% w/w (based upon the weight of the composition) of a tenside, said hydrosol containing (a) an amount in excess of its solubility limit and up to about 40% w/w of particulate sodium tripolyphosphate builder substantially uniformly distributed therein, (b) from 0.5% w/w up to about 30% w/w of at least one non-ionic surfactant, (c) from 0 to about 5% w/w of a bleach, (d) from 0 to about 5% of a bleach activator, and (e) from 0 to about. 5% w/w in total of one or more minor ingredients, any minor ingredient being present in an amount of up to about 2% w/w and being selected from preservatives, optical brighteners, fragrances, foam depressants, foam boosters, foam stabilisers, soaps, dyes, pigments, buffers, corrosion inhibitors, sequestration agents, anti-ingestion agents, humectants, enzymes, enzyme stabilisers, fabric softeners and fabric conditioners.

30. A liquid built detergent composition according to claim 29, in which the tenside is an anionic surfactant derived from a tenside acid selected from alkyl benzene sulphonic acids, in which the alkyl group contains from about 6 to about 20 carbon atoms, alkyl sulphonic acids containing from about 10 to about 26 carbon atoms, alpha-olefin sulphonic acids obtained by sulphonation of an alpha-olefin containing from about 10 to about 22 carbon atoms, and mixtures thereof.

31. A liquid built detergent composition according to claim 29, which further comprises a sulphated fatty alcohol or a sodium salt thereof.

32. A liquid built detergent composition according to claim 29, in which the at least one non-ionic surfactant comprises coconut fatty acid monoethanolamide.

33. A liquid built detergent composition according to claim 29, in which the at least one non-ionic surfactant comprises a polyoxyalkylene ether of an alkanol containing from about 6 to about 20 ethylene oxide groups and based upon an alkanol containing from about 6 to about 26 carbon atoms.

34. A liquid built detergent composition according to claim 1, in which the builder comprises a zeolite.

35. A process for the production of a liquid built detergent composition containing substantially uniformly distributed therein suspended particles of sodium tripolyphosphate builder, which process comprises neutralising a solution of an alkali metal silicate to a pH in the range of from about 1.0 to about 8.0 in the presence of a tenside thereby to produce a stable hydrosol of silicic acid and, either before or after the neutralisation step, incorporating an amount in excess of its solubility limit of particulate sodium tripolyphosphate builder in the composition in an amount of from about 5% w/w to about 40% w/w of the composition.

36. A process according to claim 35, in which neutralisation is effected by addition of an acid to a solution of an alkali metal silicate that also contains at least one surfactant and in which the sodium tripolyphosphate builder is thereafter added.

37. A process according to claim 36, in which the acid is selected from hydrochloric acid, sulphuric acid, sulphamic acid, phosphoric acid, formic acid, acetic acid, citric acid, and mixtures of two or more thereof.

38. A process according to claim 35, in which neutralisation is effected by titration of the solution of alkali metal silicate with a tenside acid containing one sulphonic acid group.

39. A process according to claim 38, in which a solution having a pH of not more than 7.0 is produced by dissolving in an aqueous medium (1) a tenside acid containing one sulphonic acid and (2) sodium tripolyphosphate and a solution an alkali metal silicate is added thereto.

40. A process according to claim 35, in which the alkali metal silicate is sodium silicate.

41. A process according to claim 35, in which the tenside is an anionic surfactant derived from a tenside acid selected from alkyl benzene sulphonic acids, alkyl sulphonic acids and alpha-olefin sulphonic acids.

42. A process according to claim 35, in which there is further added at least one non-ionic surfactant.

43. A process according to claim 42, in which the non-ionic surfactant comprises coconut fatty acid monoethanolamide.

44. A process according to claim 35, in which there is incorporated in the composition, either before or after the neutralisation step, a sulphated fatty alcohol or a sodium salt thereof.

45. A process according to claim 41, in which there is used from about 2% w/w up to about 30% w/w of anionic surfactant (calculated as sulphonic acid) based upon the total weight of the composition.

46. A process according to claim 35, in which there is incorporated in the composition, either before or after the neutralisation step about 0.5% w/w up to about 30% w/w of at least one non-ionic surfactant.

47. A process according to claim 46, in which the at least one non-ionic surfactant comprises coconut fatty acid monoethanolamide.

48. A process according to claim 46, in which the at least one non-ionic surfactant comprises a polyoxyalkylene ether of an alkanol containing from about 6 to about 20 ethylene oxide groups and based upon an alkanol containing from about 6 to about 26 carbon atoms.

49. A process according to claim 35, in which there is used from about 3% w/w up to about 8% w/w of sodium silicate based upon the weight of the composition.

50. A process according to claim 35, which further includes incorporating in the composition, either before or after the neutralisation step, at least one material selected from preservatives, optical brighteners, bleaches, fragrances, foam depressants, foam boosters, soaps, dyes, buffers, corrosion inhibitors, sequestration agents, bleach activators, enzymes, humectants, and enzyme stabilisers.

51. A process according to claim 35, in which the pH of the resulting composition is in the range of from about 4.0 to about 9.0.

52. A process according to claim 9, in which the builder comprises a zeolite.

* * * * *

UNITED STATES PATENT AND TRADEMARK OFFICE

CERTIFICATE OF CORRECTION

PATENT NO. : 5,601,749

DATED : February 11, 1997

INVENTOR(S) : Sean G. Hall, et al.

It is certified that error appears in the above-indentified patent and that said Letters Patent is hereby corrected as shown below:

Column 4, line 12: "one-produced" should read --one produced--

Column 5, line 51; after " $C_{12}$ " insert --49.5%, $C_{14}$ 19.5%, $C_{16}$ 8.5%, $C_{18}$ (stearic) 2.0%, $C_{18}$ (oleic)-

Signed and Sealed this

Seventeenth Day of February, 1998

Bruce Lehman

*Attest:*

BRUCE LEHMAN

*Attesting Officer*

*Commissioner of Patents and Trademarks*